US006170498B1

(12) United States Patent
Wu

(10) Patent No.: US 6,170,498 B1
(45) Date of Patent: Jan. 9, 2001

(54) MULTIPLE-FOLD AUTOMATIC UMBRELLA

(76) Inventor: Woh-Wen Wu, 8F. No.76. Ln.103. Sec. 2. NeiHu Rd., Taipei (TW)

( * ) Notice: Under 35 U.S.C. 154(b), the term of this patent shall be extended for 0 days.

(21) Appl. No.: 09/413,826

(22) Filed: Oct. 7, 1999

(51) Int. Cl.[7] ..... A45B 25/16
(52) U.S. Cl. ..... 135/24; 135/22
(58) Field of Search ..... 135/15.1, 20.3, 135/22, 23, 28, 24, 25.1, 25.3, 25.31, 25.32, 25.33, 31, 38, 40

(56) References Cited

U.S. PATENT DOCUMENTS 5,178,174 * 1/1993 Wu ..... 135/24
5,617,889 * 4/1997 Wu ..... 135/22
5,626,160 * 5/1997 Ko ..... 135/24
5,645,094 * 7/1997 Wu ..... 135/24
5,823,215 * 10/1998 Chou et al. ..... 135/24
6,016,822 * 1/2000 Lin et al. ..... 135/24

* cited by examiner

*Primary Examiner*—Peter M. Cuomo
*Assistant Examiner*—Jerry Anderson
(74) *Attorney, Agent, or Firm*—Dougherty & Troxell

(57) ABSTRACT

An multiple-fold automatic umbrella includes a telescopic central shaft which constitutes a plurality of movable and overlapping tubes, a rib assembly, a grip, a control means, an extending spring and a plurality of retracting springs. Pressing the control means may trigger an umbrella opening means to stretch the extending spring for extending the overlapping tubes to open the umbrella or to close the umbrella through the retracting springs. The central shaft has an inner block and a rope guide disposed at the tope end to replace conventional rollers. The inner connection rib in the rib assembly is made of metallic wire for increasing the space to install retracting springs, diminishing the retracted volume of an umbrella, and reducing production cost.

3 Claims, 8 Drawing Sheets

MULTIPLE-FOLD AUTOMATIC UMBRELLA

BACKGROUND OF THE INVENTION

1. Field of the Invention

This invention relates to a multiple-fold automatic umbrella and particularly to an improved multiple-fold automatic umbrella that has low production cost and high durability.

2. Background of the Invention

Conventional multiple-fold automatic umbrella (such as the four-fold one shown in FIG. 1) basically adapts and expands the structural design of the two-fold or three-fold automatic umbrella. It mainly includes a central shaft means A consisting of four telescopic tubes; a rib assembly B constituting at least: a top rib c pivotally engaged with an upper notch D located at the top end of the central shaft means A, a stretcher rib E pivotally engages with the top rib c and a lower runner F slidably engaged with the central shaft means A, a middle rib G engaged with an outer rib J by means of an outer resilient rib H and an outer connection rib I, the middle rib G further has one end engaging with the stretcher rib E and the top rib c through an inner connection rib K and another end engaging with an inner resilient rib L and the outer connection rib I; an extending spring M located in the central shaft means A for opening the umbrella, a plurality of retracting springs N located in the rib assembly B for closing the umbrella; and a control means P including an upper guide roller Q pivotally located at an upper portion of the central shaft means A, a lower guide roller R pivotally located in the lower runner F and top guide rollers S and X pivotally located at the top end of the central shaft means A for winding a rope T among the rollers to form a multiple-fold automatic umbrella mechanism. The rope T has an inner end fixed on a rod U axially located in the central shaft means A and another end winding through an upper shaft V and the central shaft means and the upper guide roller Q held in an inner block W located at the top portion of the central shaft means, then winding downward around the lower guide roller R and extending upward again to wind around the top guide rollers S and X, and finally winding downward again to engage with the lower runner F. The winding rope T has to change direction several times. The inner block W is small size but has to contain three rollers. The whole assembly becomes bulky. There are many components and is difficult to assemble. The inner connection rib K usually is made by punching a metallic sheet. It is large size and increases cost. The whole design and structure is against the contemporary design concept and trend which focuses small size and light weight.

SUMMARY OF THE INVENTION

In view of the aforesaid disadvantages, it is therefor an object of this invention to provide an improved multiple-fold automatic umbrella that includes a telescopic central shaft means, a rib assembly, a grip, a control means, an extending spring and a plurality of retracting springs in which the central shaft means has a low friction and high wearing resistance rope guide located at the top end of the inner block to replace the upper and top guide rollers used in the conventional multiple-fold umbrella and may result in easy assembling, lower cost, smaller size and enhanced durability.

It is another object of this invention to provide an improved multiple-fold automatic umbrella in which the inner connection rib for connecting the top rib and middle rib and for engaging with the retracting spring is made of metallic wire rather than a metallic bar made by punching for achieving smaller size and lower cost.

BRIEF DESCRIPTION OF THE DRAWINGS

The invention, as well as its many advantages, may be further understood by the following detailed description and drawings in which.

DETAILED DESCRIPTION

Figure 1:
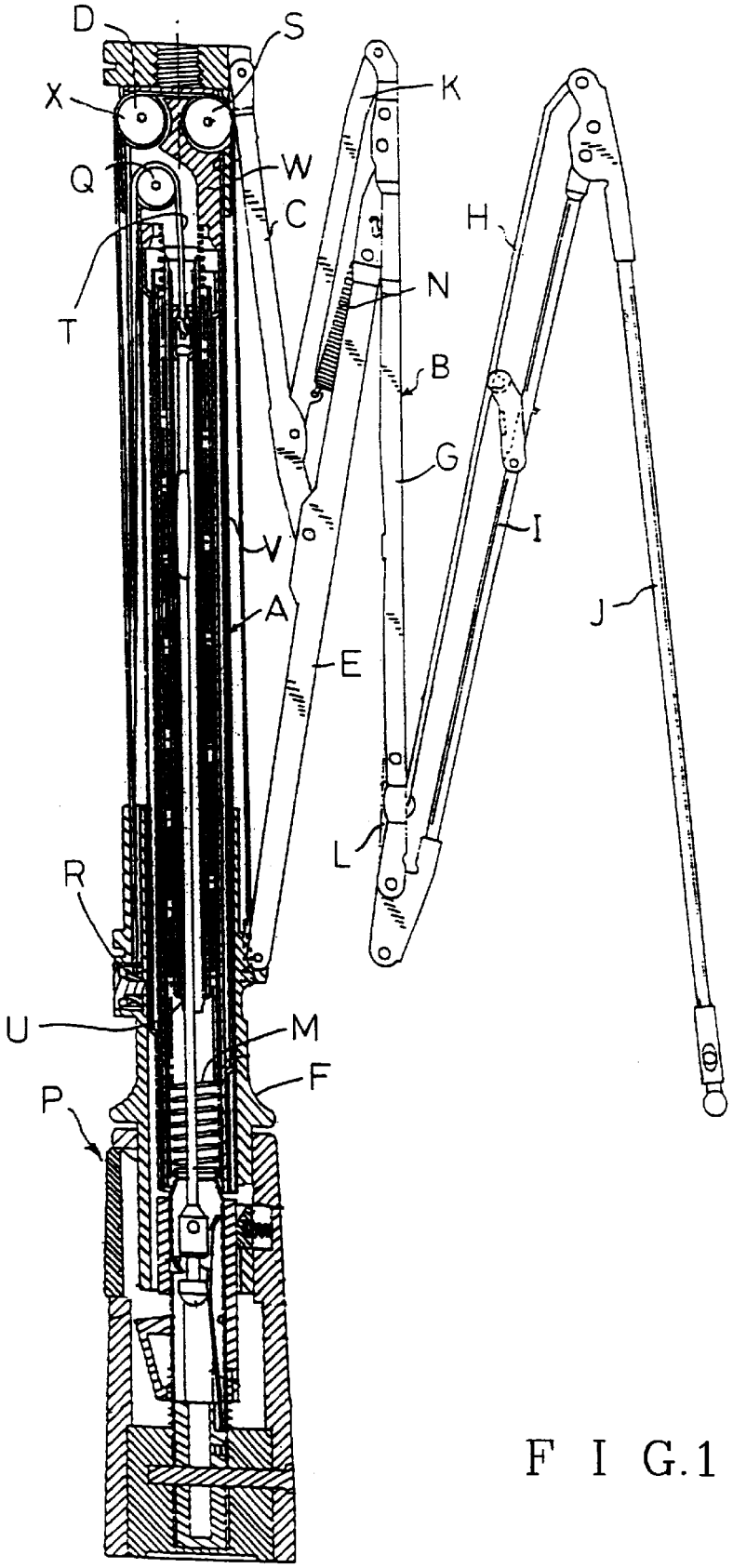
FIG. 1 is a schematic view of a conventional four-fold automatic umbrella.
Figure 2:
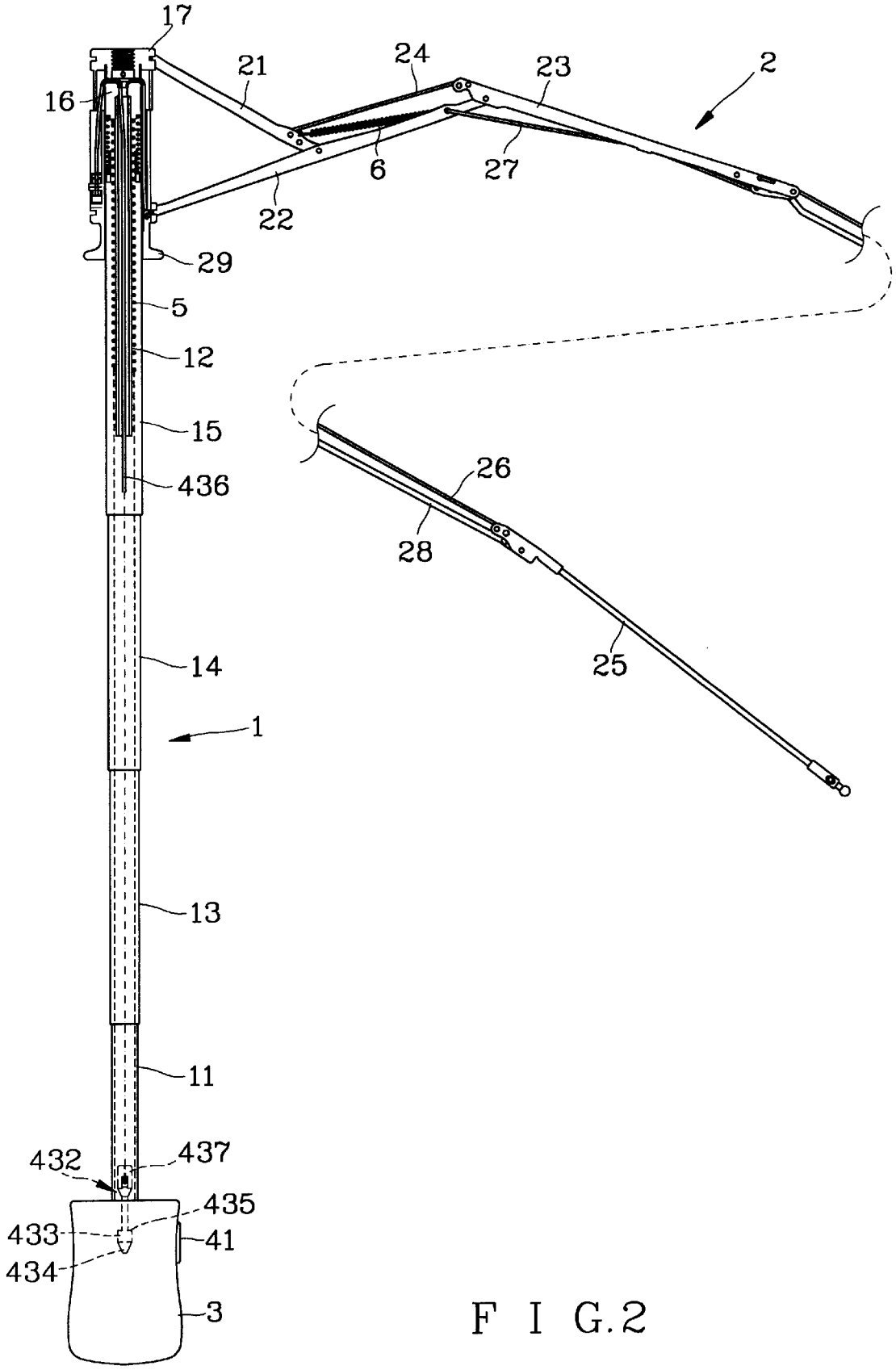
FIG. 2 is a schematic view of this invention, at an extended state.
Figure 3:
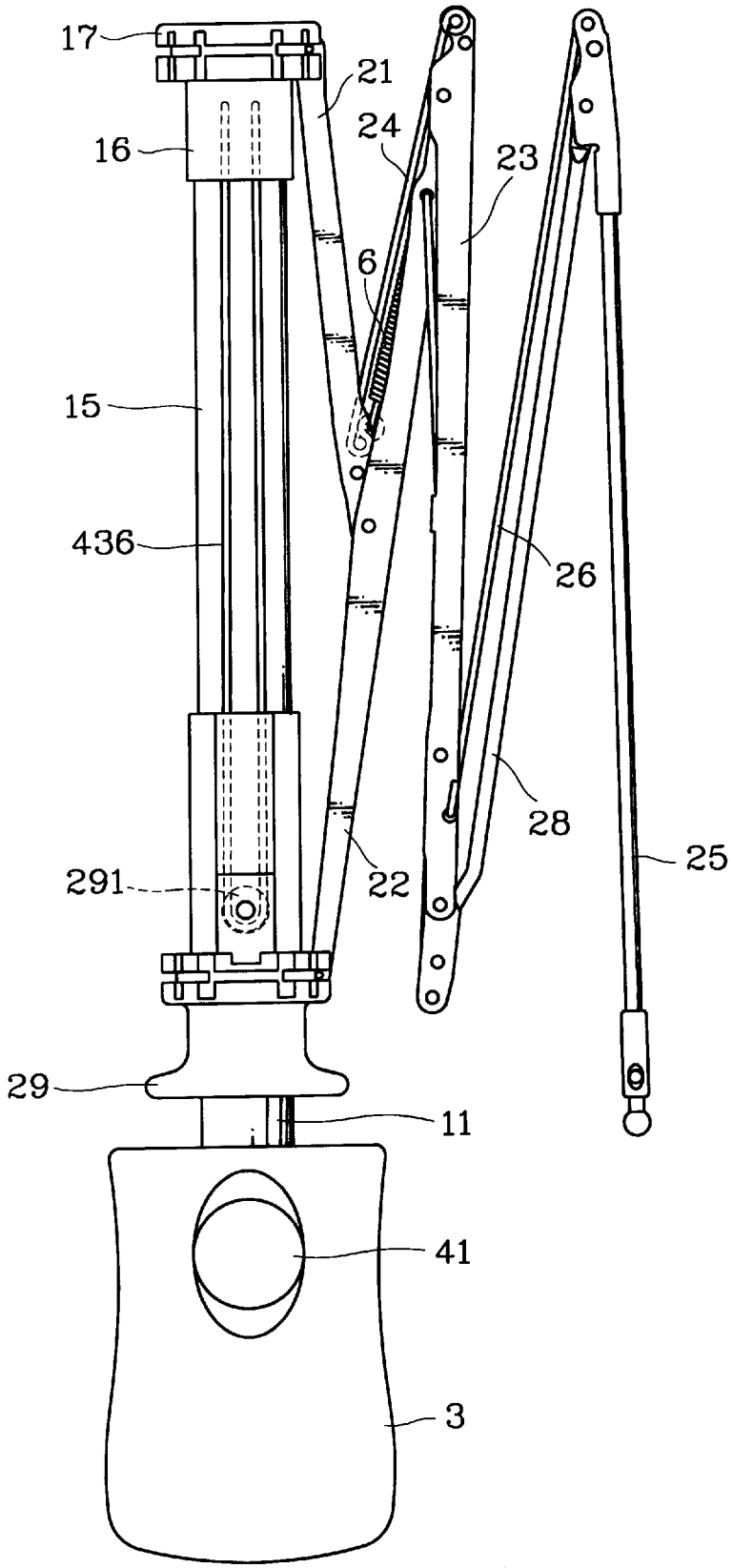
FIG. 3 is a schematic view of this invention, at a retracted state.
Figure 4:
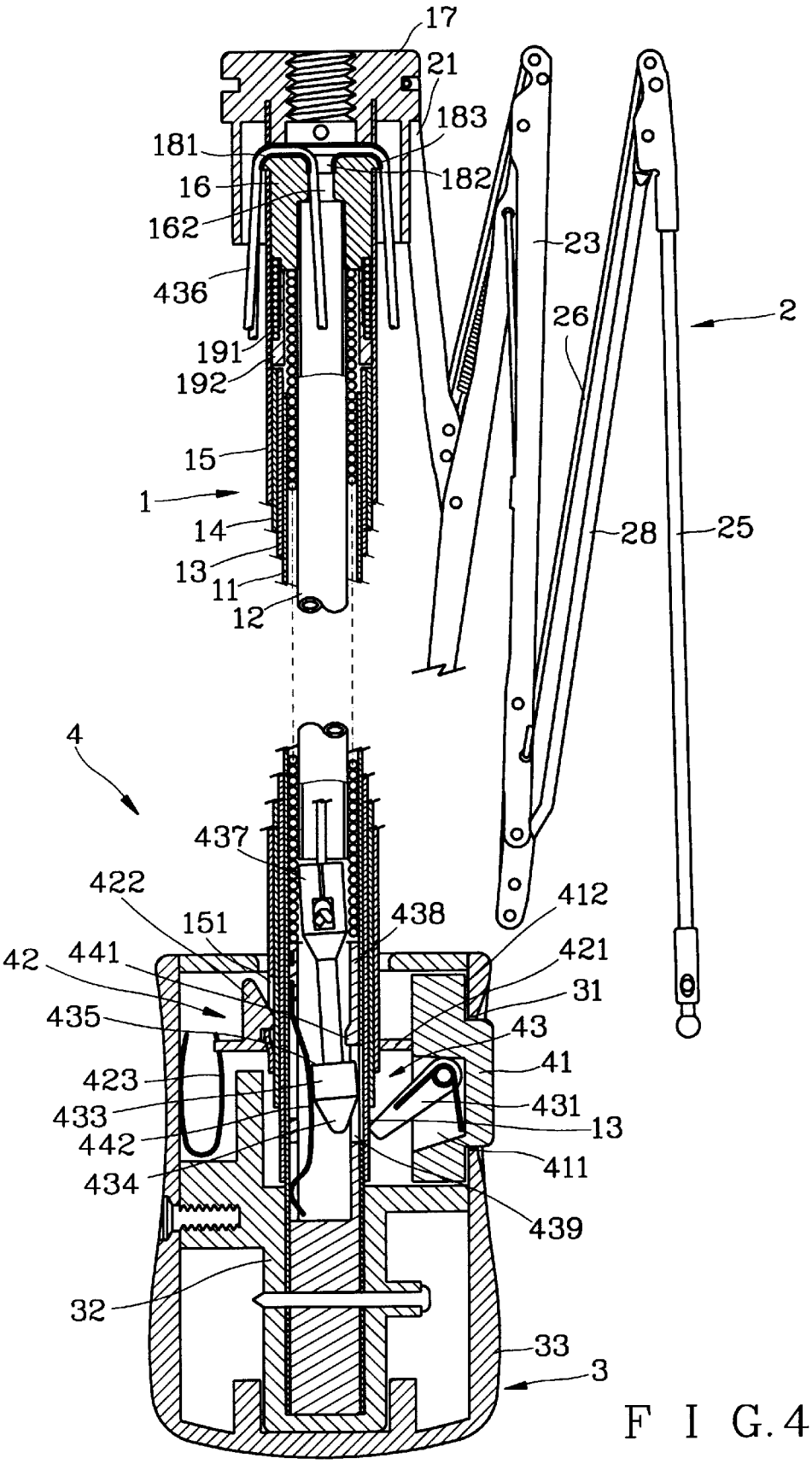
FIG. 4 is a sectional view of this invention at the retracted state.
Figure 5:
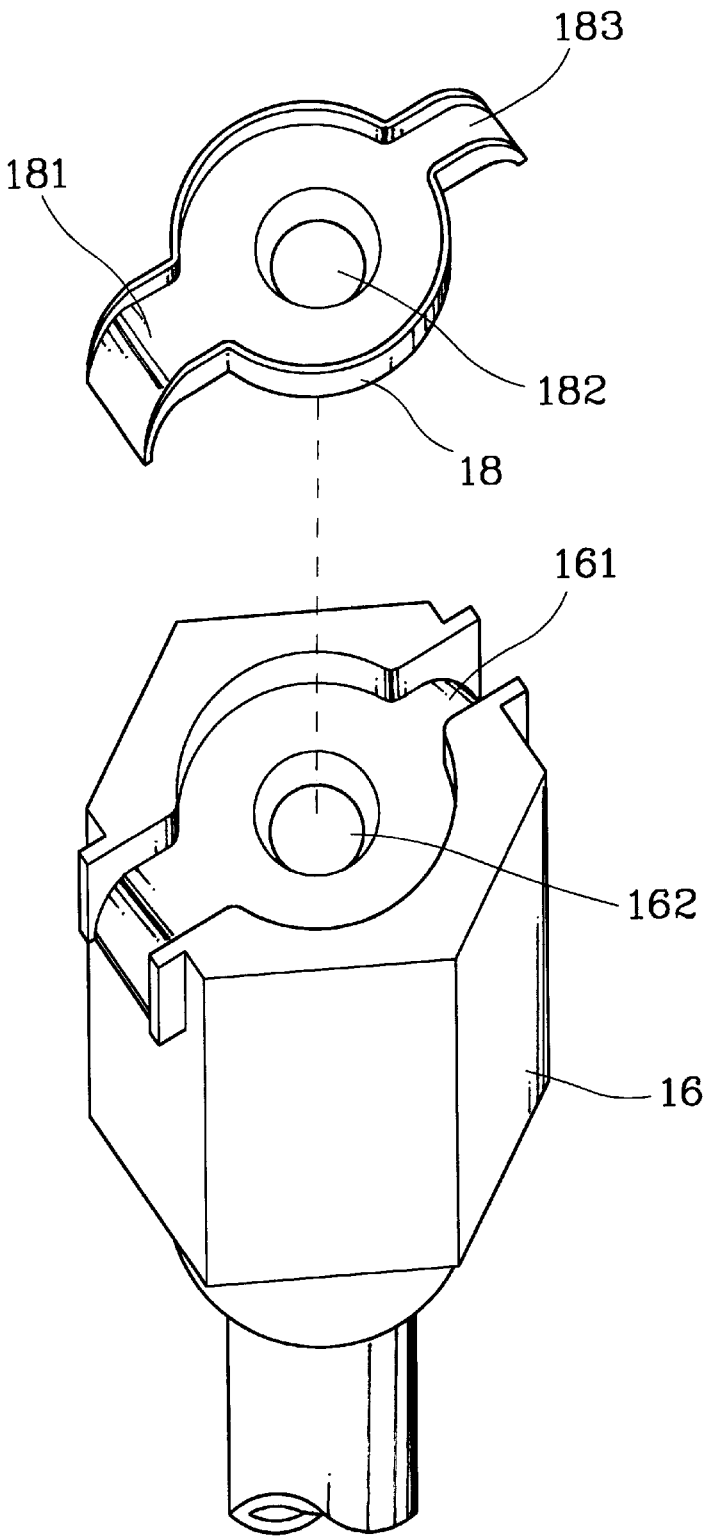
FIG. 5 is a perspective exploded view of an inner block and a rope guide of this invention.

Referring to FIGS. 2–6, this invention includes a central shaft 1, a rib assembly 2 for holding umbrella cloth, a grip 3, a control means 4, an extending spring 5 and a plurality of retracting springs 6.

The central shaft 1 includes a lower shaft 11, a first middle shaft 13, a second middle shaft 14 and an upper shaft 15 telescopically engaged with one another with the lower shaft 11 located in the center and the upper shaft 15 located outmost. The lower shaft 11 has a lower portion engaged with the grip 3. The top end of the upper shaft 15 has an inner block 16 inserted therein. At the top of the inner block 16, there is a groove 161 transversely formed and a through bore 162 axially formed therein running through the center of the inner block 16 and the groove 161. The groove 161 engages with a rope guide 18. There is an upper notch 17 mounted on the inner block 16 from the top thereof The rope guide 18 is made of a material of low friction coefficient and high wearing resistance. It has a front rope groove 181, a rear rope groove 183 and a center hole 182 mating respectively with the groove 161 and through bore 162.

The outer rims of the grooves 181 and 183, and the juncture between the center hole 182 and the grooves 181 and 183 are formed in smooth curve for the rope 436 to wind around the grooves 181, 183 and through the center hole 182 smoothly. It thus may replace the top and upper guide rollers for winding rope that used in the conventional umbrella. It may greatly reduce cost, increase assembly efficiency and enhance product stability.

The rib assembly 2 includes a top rib 21 which has one end pivotally engaged with the upper notch 17, a stretcher rib 22 which has a middle portion engaged with another end of the top rib 21 and an inner end pivotally engaged with a lower runner 29 which in turn slidably engages with the upper shaft 15, a middle rib 23 which has an inner end pivotally engaged with another end of the stretcher rib 22 and an inmost end pivotally engaged with a first hook eye 241 located at outmost end of an inner connecting rib 24 which further has a second hook eye 242 located at an inner end thereof engaged with an outer end of the top rib 21, and an outer rib 25 having an inmost end pivotally engaged with an outer end of an outer resilient rib 26 which has an inner end engaged with an outer end of the middle rib 23. There is an inner resilient rib 27 located at a side of the middle rib 23 for bridging between the outer end of the stretcher rib 22 and the inmost end of the outer connecting rib 28. The outer connecting rib 28 further has an inner end pivotally engaged with an outmost end of the middle rib 23 and an outer end engaged with an inner end of the outer rib 25.

Figure 9A:
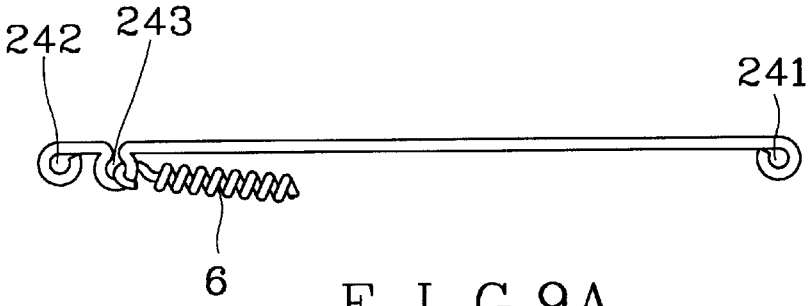
FIGS. 9A, 9B and 9C are schematic views of various embodiments of the inner connection rib of this invention.
Figure 9B:
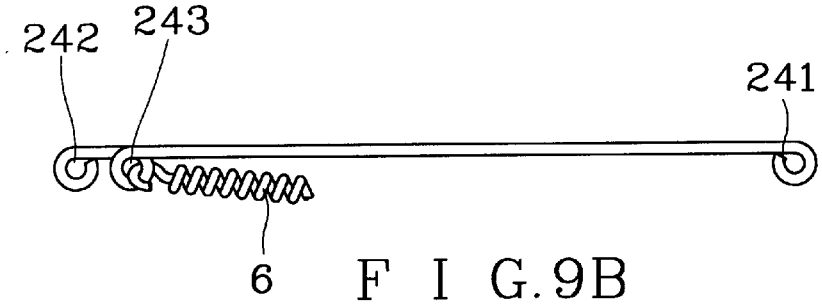
Figure 9C:
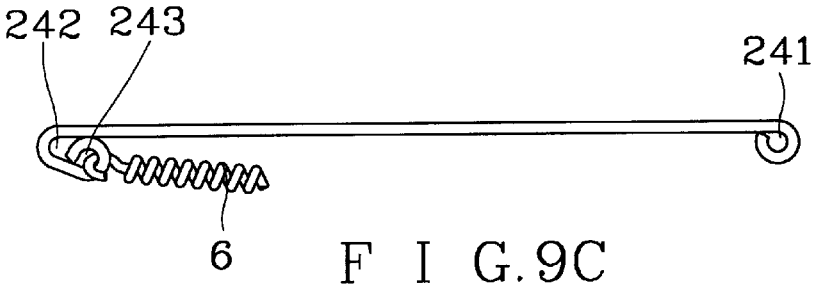

Referring to FIG. 9A, the inner connection rib 24 is made of metallic wire to form the first hook eye 241 at one end and the send hook eye 242 and a third hook eye 243 at another end. The third hook eye 243 is for engaging with the retracting spring 6. FIGS. 9B and 9C show other embodiments for the inner connection rib 24.

The extending spring 5 has a lower end engaged with a low control tube 438 located in the lower shaft 11 and an upper end engaged with the bottom of the inner block 16 in the upper shaft 15. There is a center guide tube 12 axially located inside the extending spring 5 to facilitate the extension and retraction of the spring 5 and to move a locking head 433 located in the closing controller 43 which will be described later.

The restracting spring 6 has an inner end engaged with the third hook eye 243 of the inner connection rib 24 and an outer end engaged with an outer end of the stretcher rib 22 for storing spring energy for retracting umbrella use when the umbrella is opened.

The control means 4 employs the structure disclosed in U.S. Pat. Nos. 5,617,889 and 5,645,094 which were granted to the applicant. The control means 4 mainly includes a push button 41, an opening controller 42 and the closing controller 43. The push button 41 has a rod cavity 411 formed inside and a shoulder 412 formed outside, and is movable through a button opening 31 in the grip 3 but will be held without disengaging from the grip.

The opening controller 42 includes a pair of bifurcate member 421 movably located in an inner seat 32 formed in the grip 3 with an opening slot facing the push button 41, a wedge member 422 located in front of the bifurcate member 421 having a slant finger facing the center line of the central shaft 1 and a rear end engaged with an engaging spring 423 housed in a spring chamber formed in the grip 3 for pushing the slant finger to engage with a snap opening 151 formed in the upper shaft 15. The restoring spring 423 may push the wedge member 422, and the bifurcate member 421 well be push forward which in turn pushes the push button 41 outward of the grip 3 (shown in FIG. 4).

Figure 6:
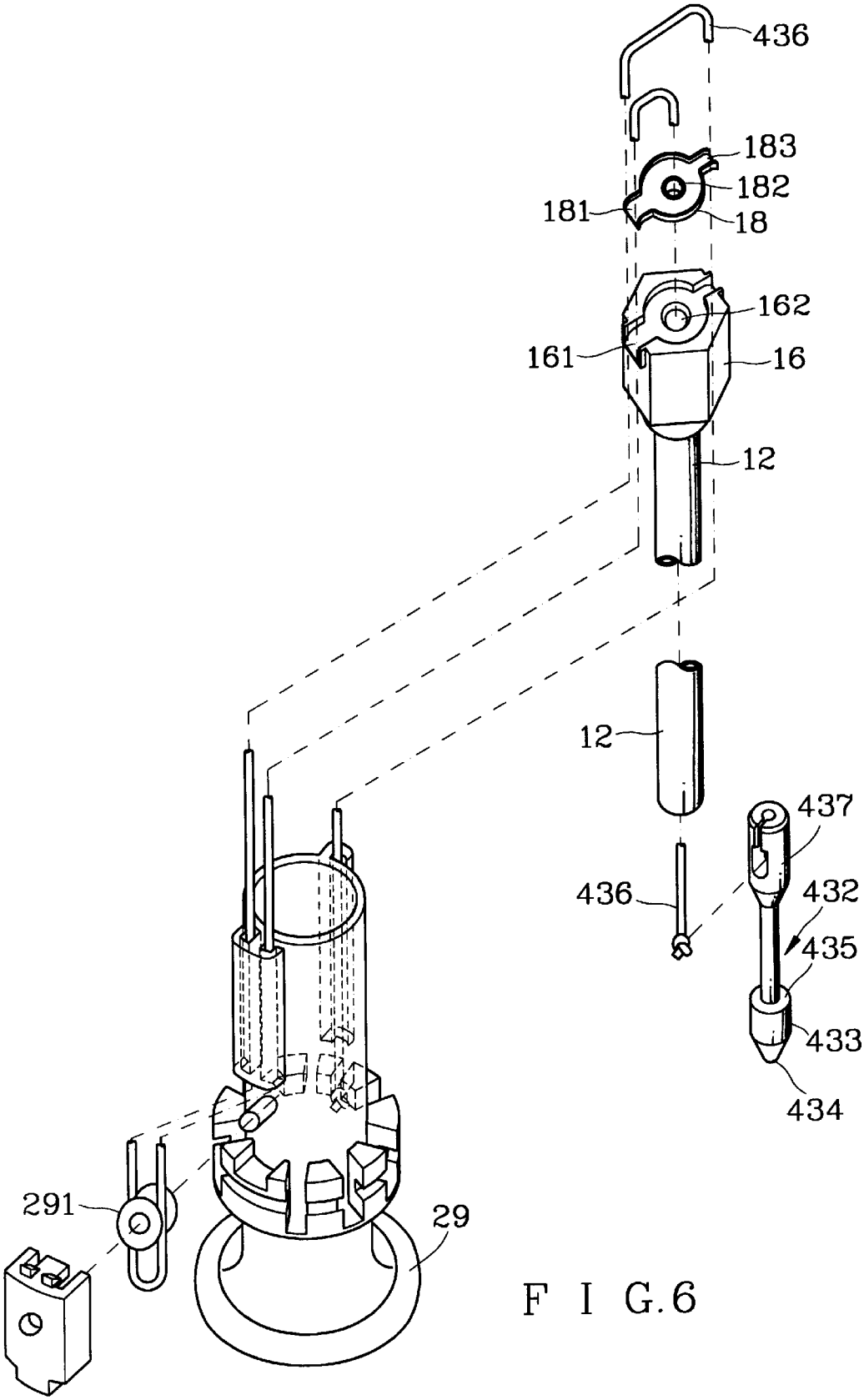
FIG. 6 is a schematic view of the rope-winding scheme according to this invention.
Figure 7A:
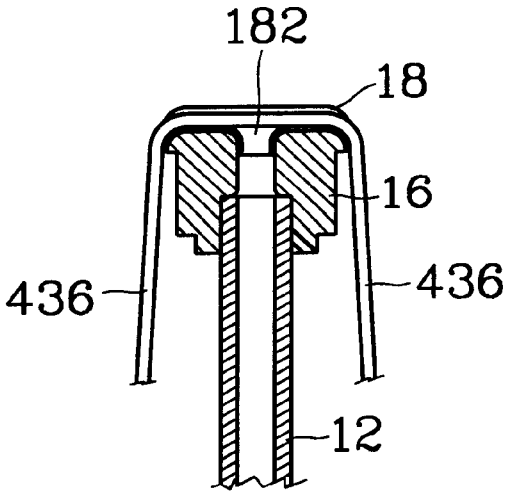
FIGS. 7A and 7B are fragmentary sectional views of an inner block and a rope guide of this invention.
Figure 7B:
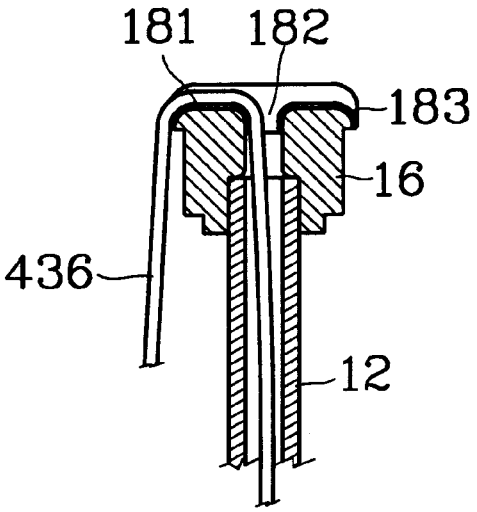
Figure 8:
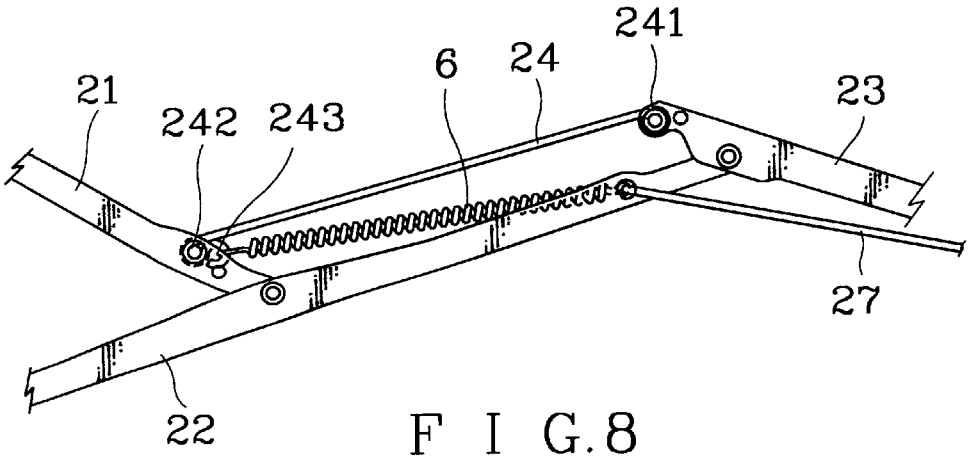
FIG. 8 is a schematic view of an inner connection rib and a retracting spring used in this invention.

The closing controller 43 includes a resilient pushing rod 431 which maintains horizontal when not in use but may be pushed to tilt downward by the bottom end of the first middle shaft 13 which is moved downward in a center hole of the grip 3 when performing umbrella closing operation, a locking head means 432 (shown in FIG. 6) which has a locking head 433, an arcuate bottom 434, a shoulder 435 and a knot socket 437 connecting with the locking head 433 through a neck stem, a low control tube 438 hosed in the lower shaft 11 having through opening 439 formed in a side wall facing the resilient pushing rod 431 and a wedge nose 441 formed above the through opening 439 and a strip spring 442 located at another side opposite to the through opening 439, and a rope 436 which has a bottom end engaging with the knot socket 437 (FIG. 6). The top end of the rope 436 runs through the center of the central shaft 1 and center guide tube 12, then passes through the inner block 16 and center hole 182 of the rope guide 18, winds through the front rope groove 181 to outside of the central shaft 1 and downward to a roller 291 held in the lower runner 29, then winds upward to pass through the front and rear rope groove 181, 183, and then winds downward again to fasten with the lower runner 29 (shown in FIG. 6).

When the umbrella is retracting, the knot socket is pushed downward by the bottom end of the center guide tube 12, and the arcuate bottom 434 is pushed sideward by the strip spring 442 such that the locking head is moved toward the through opening 439 until the shoulder 435 engaged with the wedge nose 441.

At the same time, the resilient pushing rod 431 is depressed by the first middle shaft 13 and is bent to pose separately with respect to the locking head 433.

When there is a need to open the umbrella, pressing the push button 41 to move the bifurcated member 421, the wedge member 422 will be pushed rearward and disengage from the snap opening 151. The extending spring 5 is free to push the upper shaft 15 upward which in turn moves all other telescopic tubes including the second middle shaft 14, the first middle shaft 13 upward until the central shaft 1 extending to full length. In the mean time, the rib assembly 2 and the umbrella cloth laid over it are fully extended. The rope 436 which is wound around between the upper notch 17 and lower runner 29 and locking head 433 is under tension. The locking head 433 engages with the wedge nose 441. The restoring spring 6 is extended to store restoring energy but cannot retract due to latching of the locking head 433 by the wedge nose 441. The umbrella thus is fully opened and extended for use.

For retracting and closing the umbrella, releasing the push button 41 to make the resilient pushing rod 431 become horizontal. Then press the push button 41 again which in turn pushes the resilient pushing rod 431 and moves the locking head 433 disengaged from the wedge nose 441. The restoring spring 6 is free to retract and moves the lower runner 29 downward to fold the ribs. In the mean time the knot socket 437 engages with the bottom rim of the center guide tube 12 to become an umbrella folding state.

To resort the spring energy of the extending spring 5, grabbling the grip 3 and the upper notch 17 to push the inner block 16 downward to press a coupling spring 191 and a slide ring 192 which will move the second middle shaft 14 and the first middle shaft 13 downward, and the bottom rim of the upper shaft 15 pushes aside the wedge member 422. Then the engaging spring 423 pushes the wedge member 422 against to latch on the snap opening 151. At this state, the central shaft is fully retracted. The extending spring 5 is compressed to store energy for next time extending use. The center guide tube 12 also pushes the locking head 433 to engage with the wedge nose 441. Through the first middle shaft 13, the resilient pushing rod 431 may be turned for an angle so that the pushing rod 431 cannot make contact with the locking head 433. It becomes an umbrella retracting and closed state. It is to be noted that the inner block 16 may also be made of low friction and high wearing resistance material so that the rope guide 18 may be dispensed to further reduce the cost.

It may thus be sent that the objects of the present invention set forth herein, as well as those made apparent from the foregoing description, are efficiently attained. While the preferred embodiment of the invention have been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An automatic umbrella comprising:

a central shaft means including a tubular lower shaft which has a lower portion engaged with a grip and is telescopically engageable with an inside wall of a tubular first middle shaft, a tubular second middle shaft telescopically engageable with an outside wall of the first middle shaft, and a tubular upper shaft telescopically engageable with an outside wall of the second middle shaft, the upper shaft having an inner block inserted at a top end thereof; the inner block having a groove formed at a top surface, a through hole formed in a center of the groove and an upper notch mounted above the top thereof;

a rib assembly including a plurality of top ribs, stretcher ribs, inner connections ribs and middle ribs pivotally engaged with each other and pivotally engaged with the upper notch and a lower runner for holding an umbrella cloth thereon;

an extending spring held inside the upper, the middle and the lower shafts surrounding a center guide tube which has a top end engaged with a lower end of the inner block, and having a top spring end making contact with a lower end of the inner block and a bottom spring end engageable with a top rim of a lower control tube located in the lower shaft for opening the umbrella;

a plurality of retracting springs engageable with the rib assembly for restoring, retracting and closing the umbrella; and a control means including a push button movably located in the grip, an umbrella opening means movable by the push button for opening the umbrella, and an umbrella closing means movable by the push button for closing the umbrella;

wherein the top surface of the inner block has a rope guide disposed thereon, the rope guide is made of lower friction coefficient and high wearing resistance material and has arcuate front and rear grooves and a center hole for a rope to slide over.

2. The automatic umbrella of claim 1, wherein the inner block is made of low friction coefficient and high wearing resistance material.

3. The automatic umbrella of claim 1, wherein the inner connection rib is made of metallic wire and has a first hook eye formed at one end, and a second and a third eye formed at another end for engaging one end of the retracting spring.

* * * * *